United States Patent [19]

Stewart

[11] 3,968,190

[45] July 6, 1976

[54] METHOD OF MOLDING A SPHERICAL STRUCTURE

[76] Inventor: James L. Stewart, 636 Church St., Logan, Ohio 43138

[22] Filed: June 26, 1974

[21] Appl. No.: 483,372

[52] U.S. Cl. ..... 264/32; 249/20; 264/33; 264/34

[51] Int. Cl.[2] ..... E04B 1/16

[58] Field of Search ..... 264/31, 32, 33, 34, 264/35; 249/20; 425/63, 64, 65

[56] References Cited

UNITED STATES PATENTS

| | | | |
|---|---|---|---|
| 1,208,398 | 12/1916 | Stoeser | 264/33 |
| 1,995,692 | 3/1935 | Urschel | 249/20 |
| 2,705,359 | 4/1955 | Strandberg | 264/33 X |
| 3,016,595 | 1/1962 | Durst | 264/33 |

*Primary Examiner*—Robert F. White
*Assistant Examiner*—Thomas P. Pavelko

[57] ABSTRACT

A substantially spherical shaped structure constructed of reinforced concrete poured in a plurality of courses, each course consisting of a horizontal substantially annular band extending completely around the structure. A series of forms are shaped and positioned so as to create two adjacent concentric annular arcuate surfaces, thus forming an inner and an outer wall between which a suitable structural material, such as concrete, in a fluid state may be poured and allowed to harden. Additional forms, substantially vertically above and arcuately continuous with the previous surfaces, are fastened to the first series of forms and again a suitable structural material is poured between the forms and allowed to harden above the previously hardened band. This procedure is repeated until the desired spherically shaped structure has been obtained. Because of the symmetrical nature of a spherical structure, the same forms used for the lower portion of the structure may also be reversed and used in constructing the upper portion.

2 Claims, 13 Drawing Figures

METHOD OF MOLDING A SPHERICAL STRUCTURE

BACKGROUND OF THE INVENTION

2. Field of the Invention

This invention is concerned with the construction of a substantially spherical shaped structure. Specifically, this invention relates to a substantially spherical shaped structure which in the preferred embodiment has a cylindrical support or base and is constructed of reinforced concrete poured in a plurality of courses to form a dwelling. More generally, the invention concerns the construction of a substantially spherical shaped structure by the use of forms which are comprised of appropriately formed pairs of concentric rings fastened together, which rings are comprised of a plurality of sections which are also fastened together.

The interior arrangement of the structure contains various floor levels, one or more of which have open areas to facilitate air circulation and human communication within the structure.

In an embodiment illustrated, a cylinder forms a part of the structure and supports the main portion of structure which is spherical.

b. Description of the Prior Art.

Spherically shaped structures have been the subject of several patents including Beckius U.S. Pat. No. 2,166,577, Lanni U.S. Pat. No. 3,164,411, Mueller Des. U.S. Pat. No. 114,342 and Wituska (Polish) 44,582 which disclose structures which are spherical in shape. Other patents including Paine U.S. Pat. No. 1,088,239, Boniecki et al U.S. Pat. No. 3,212,220, Litchfield U.S. Pat. Des. No. 191,700, Tully U.S. Pat. Des. No. 191,699, Schluttig U.S. Pat. Des. No. 195,830, Vermette U.S. Pat. No. 3,365,855, Australia Pat. No. 107,571, and British Pat. No. 876,926 show structures which are spherical or substantially spherical in shape. None of the above cited patents described the inventions disclosed herein.

It is the usual practice to construct spherically shaped structures by one of two methods. The first method is the framework type of construction as disclosed in Beckius and Wituska. Steel girders or other suitable structural members are arranged to form meridians and parallels and thus create a spherical framework. Concrete or masonry walls are then constructed between the structural members completing the spherically shaped structure. One of the distinct disadvantages of this method is that is requires irregularly shaped structural members and a large amount of labor to construct.

The second method is the assembly type of construction as shown in Lanni and Boniecki. Preformed sections of the completed structure are fabricated at a central location and then shipped to the building site for assembly. A limitation of this method is that large structures must be constructed in an inordinately large number of sections in order that the sections may be transportable.

A method for constructing dome shaped or semi-spherical structures is disclosed in Vermette. This method employs a continuous type process whereby strips of thin gauge sheet metal are formed into a wall structure. A double wall may be constructed and concrete may be poured between the two walls. This method requires the ofter undesirable use of thin gauge metal sheets and is disclosed as limited to the construcion of dome shaped structures, and apparently cannot be used for completely spherically shaped structures.

The methods of construction previously used and disclosed in the references referred to above, do not suggest the construction of a spherically shaped structure of reinforced concrete made by successive courses of successive pourings of concrete between self standing segmented forms or that such forms may be used to construct spherically shaped surfaces. Even further, the construction of a spherically shaped structure as described herein is not even suggested by the prior art.

Beckius discloses a spherically shaped structure suitable for exposure to earthquakes. Wituska also discloses a structure based on the same general principles. Both structures, however, require a large part of their volume to be dedicated to the use for ballast. Further, both structures require a framework construction. The present invention requires no such ballast and makes optimal use of the structure's volume while retaining the strength of a spherical type of construction. At the same time, the advantages of a poured reinforced concrete structure are realized. The need for such a structure is apparent.

SUMMARY OF THE INVENTION

The invention relates to a substantially spherically shaped structure which may be readily constructed of reinforced concrete or similar structural material, to methods of constructing such a structure, and to forms to be used in such construction.

One object of the invention is to provide a substantially spherically shaped structure which can utilize the advantages inherent in the spherical shape.

A further object of the invention is to provide a structure which may be constructed of reinforced concrete poured in a plurality of courses.

Another object of the invention is the construction of a substantially spherically shaped structure by the use of a plurality of reusable, sectionalized forms which may be fastened together to create a stable form structure requiring no additional shoring.

A still further object of the invention is to provide an interior floor arrangement for a substantially spherically shaped structure which pormotes air circulation.

Further objects and features of the invention will be apparent from the following specification when considered in connection with the claims and drawings.

Figure 4:
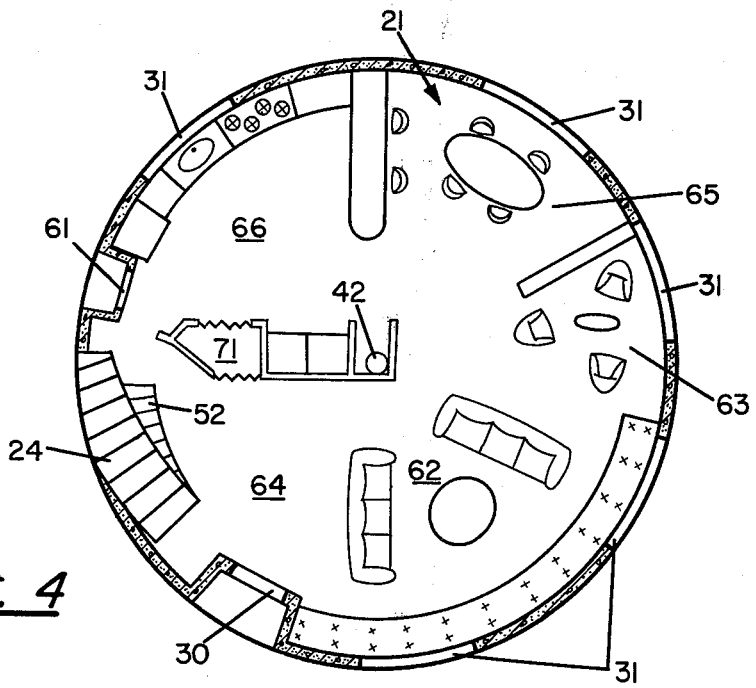
Figure 5:
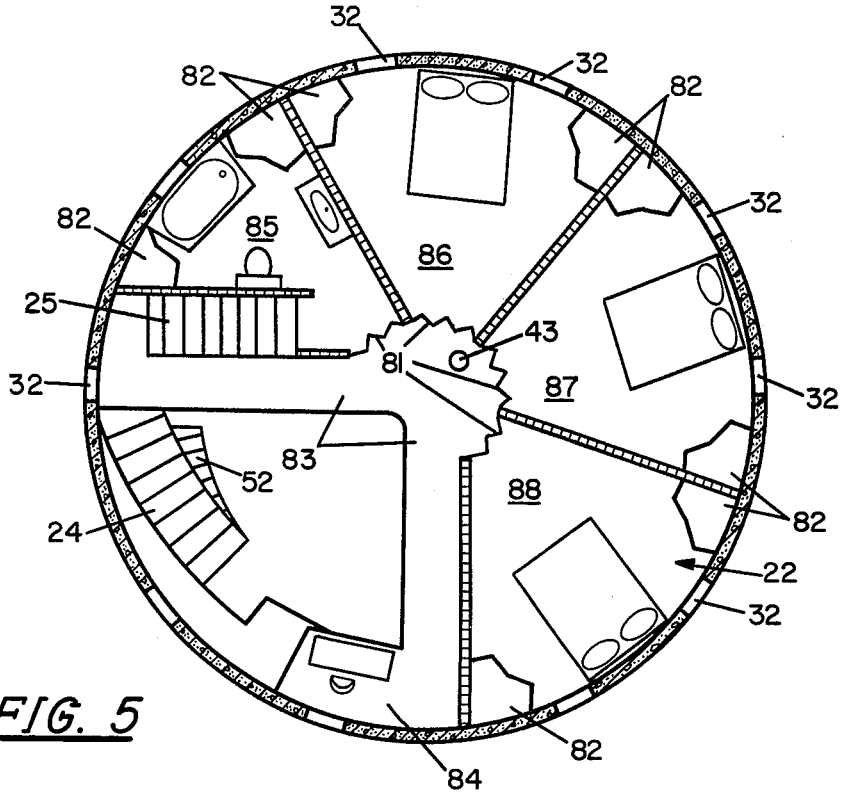
Figure 6:
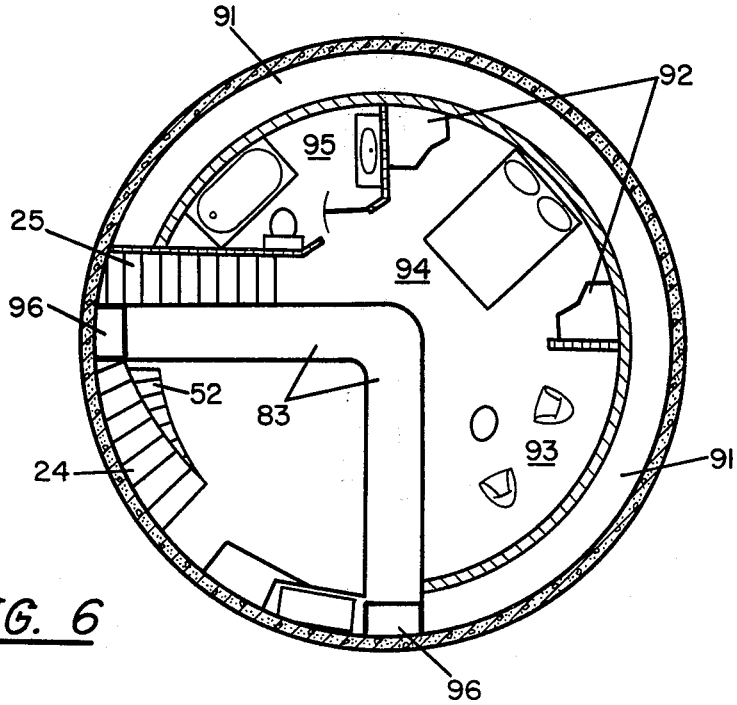

While the views shown in FIGS. 4, 5, and 6 are stated below to be horizontal sections taken on the cutting plane lines shown in FIG. 2, they are not exact sections because in FIG. 4 a part of the curved outer wall would normally be seen in the section, and in FIGS. 5 and 6 a part of the floor would normally not be seen when looking vertically downward. The Figures have been drawn as shown so as to clearly illustrate the arrangement of the rooms and the furniture which may be located therein. The size of the sections shown in FIGS. 4, 5 and 6 do not correspond with the size shown in FIG. 2.

Figure 2:
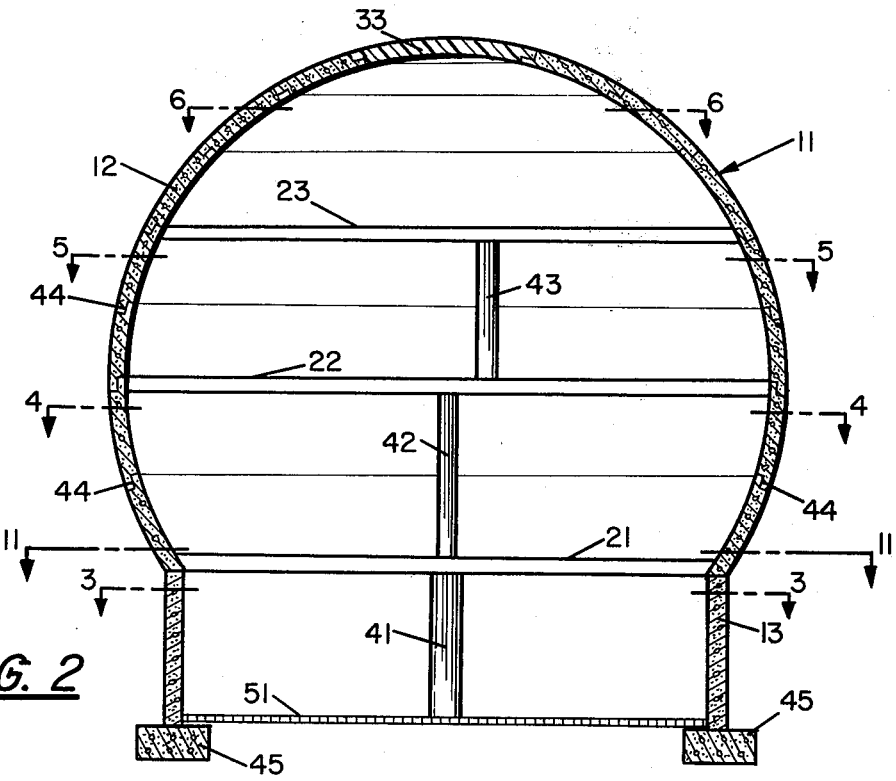
FIG. 2 is a view in vertical section of the structure shown in FIG. 1 and showing some construction details of the structure, some details such as stairs and stair wells, furniture and interior partitions, etc. being omitted in order to simplify the drawing.
Figure 7:
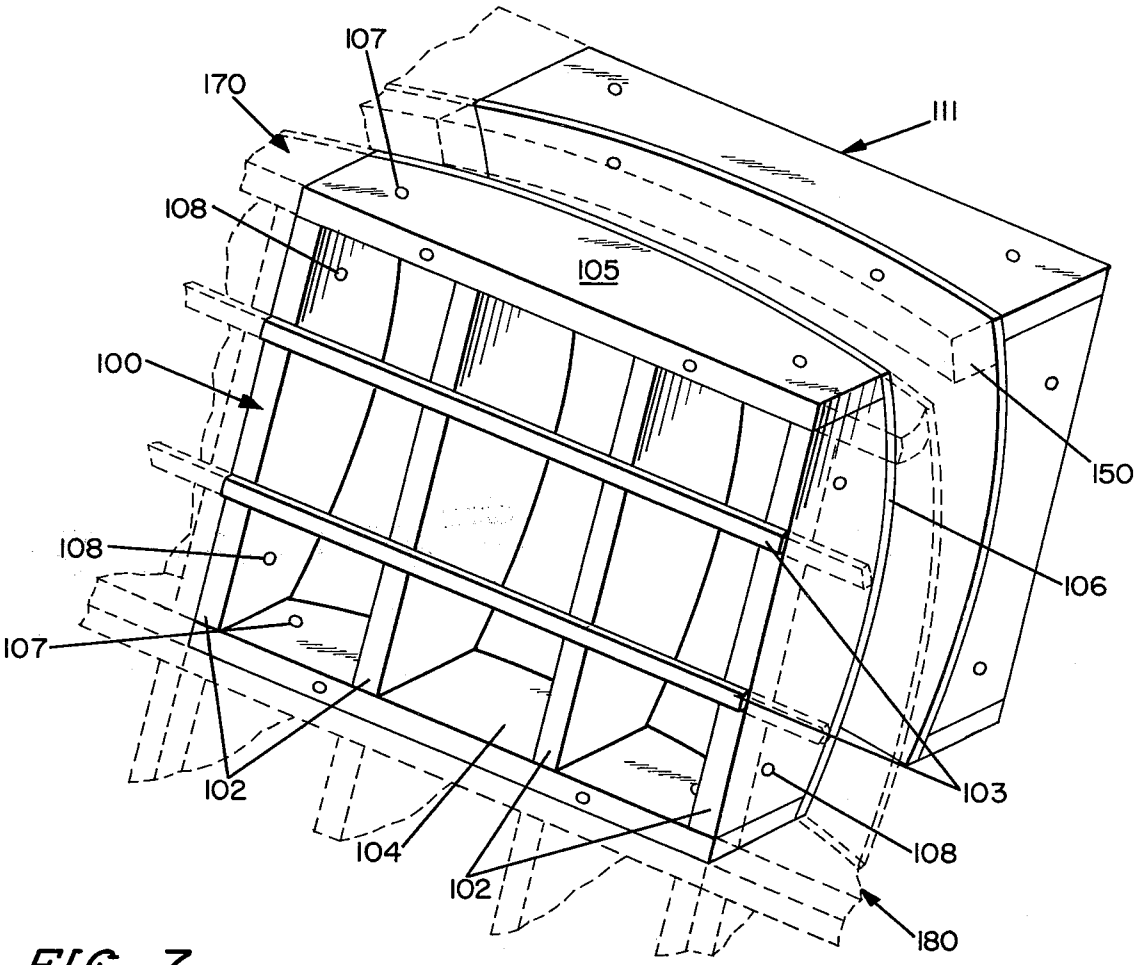
Figure 8:
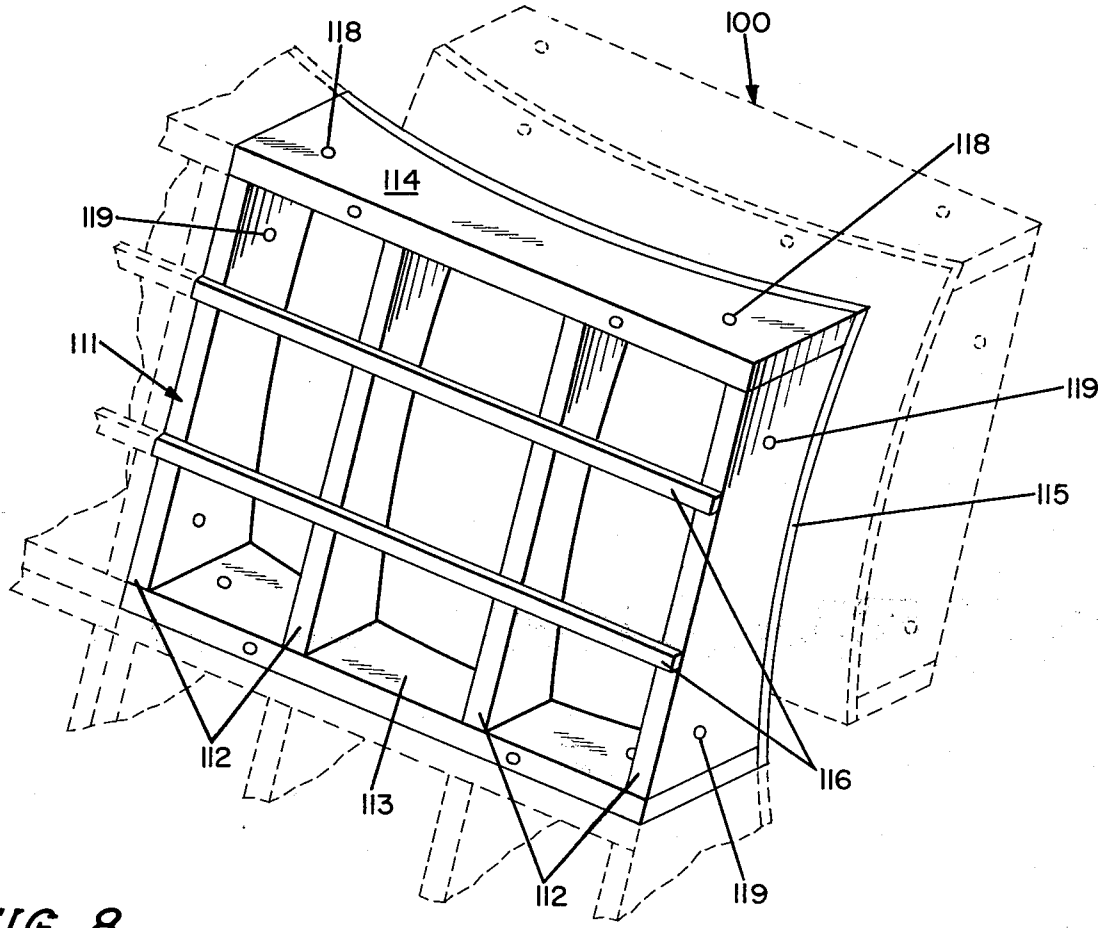
Figure 9:
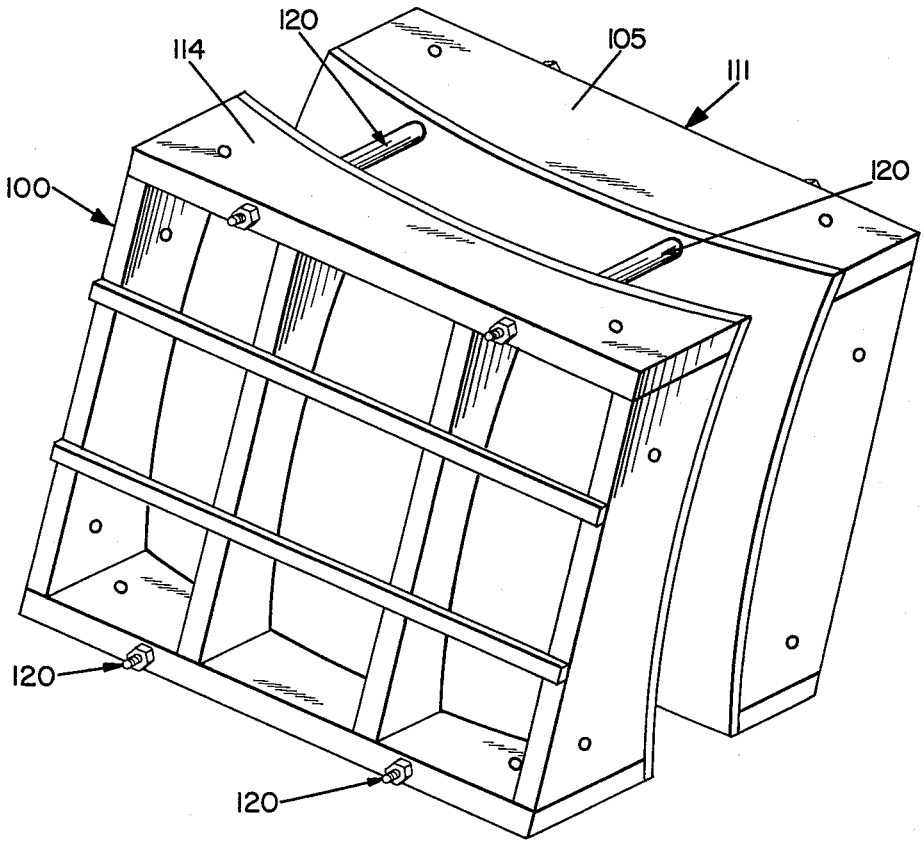
Figure 10:
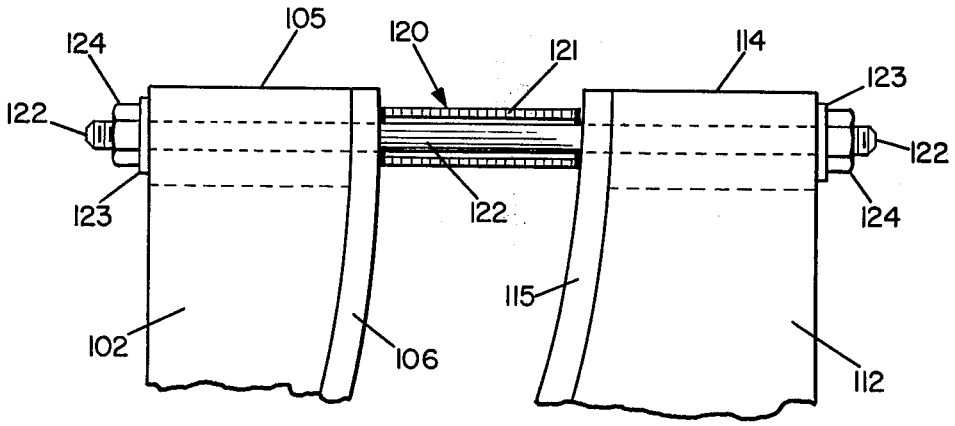
Figure 11:
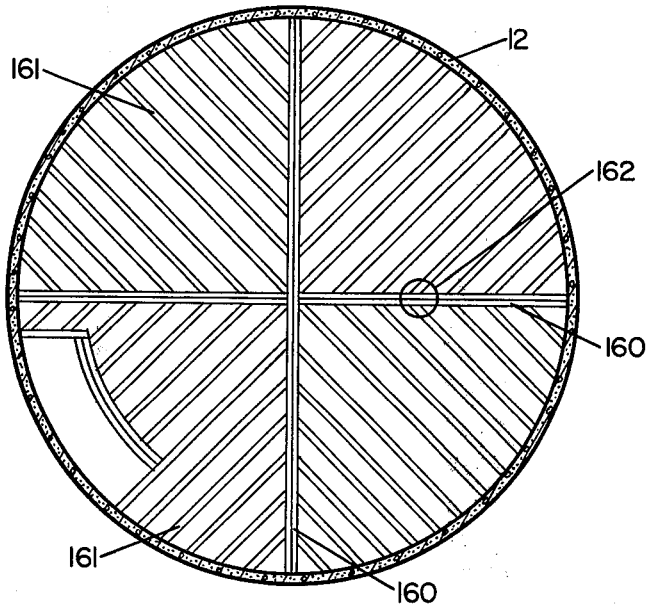
Figure 12:
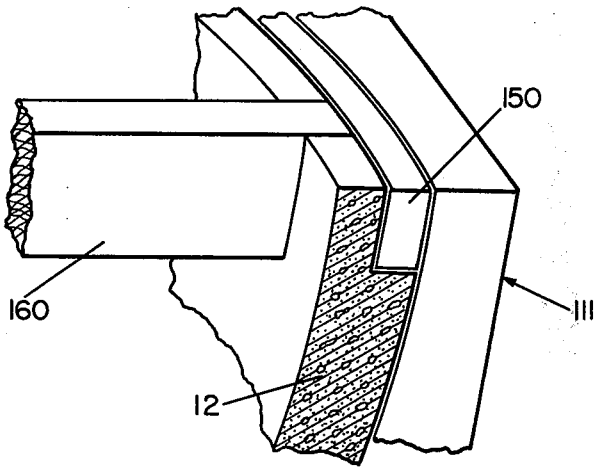
Figure 13:
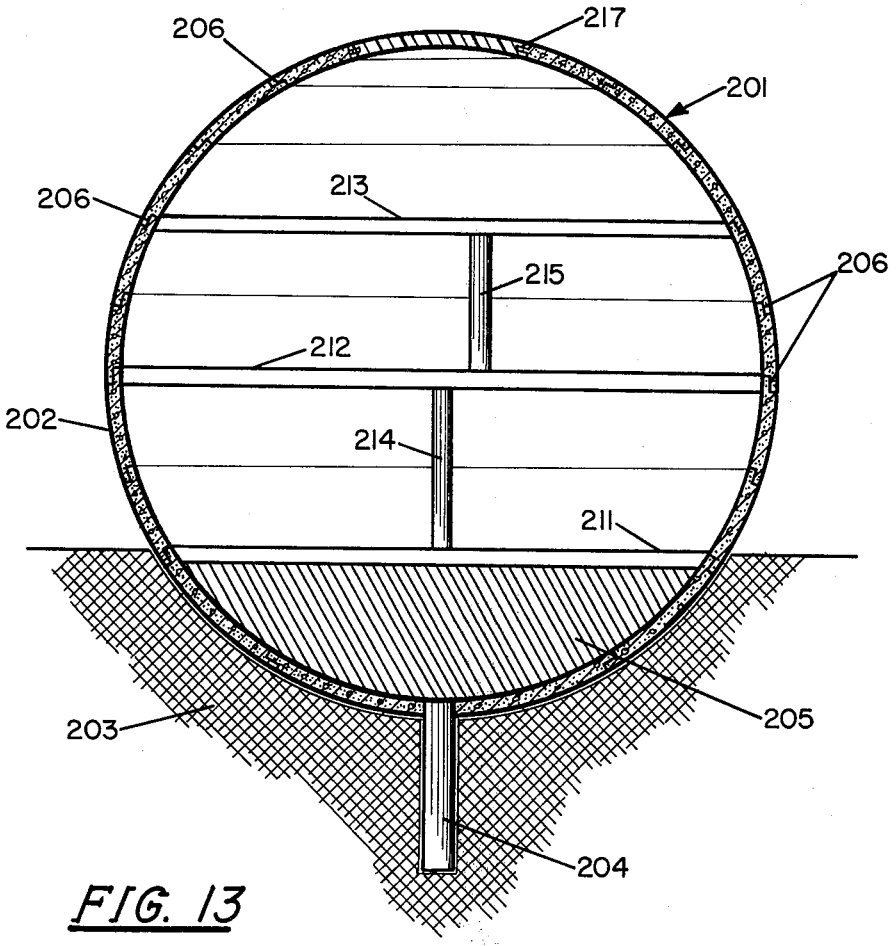

FIG. 4 is a view in horizontal section taken substantially on the line 4—4 of FIG. 2 and showing some details of the first floor;

FIG. 5 is a view in horizontal section taken substantially on the line 5—5 of FIG. 2 and showing some details of the second floor;

FIG. 6 is a view in horizontal section taken substantially on the line 6—6 of FIG. 2 and showing some details of the third floor;

FIG. 7 is a view of an inner form section showing construction details and its relationship to other inner form sections and to outer form sections;

FIG. 8 is a view in perspective of an outer form section showing its construction details, and showing in dotted lines its relationship to other outer form sections and to an inner form section;

FIG. 9 is a view in perspective of an outer and inner form section showing further details of construction and showing particularly the bolts and spacers by which the inner and outer forms are interconnected;

FIG. 10 is a fragmentary view on an enlarged scale showing more in detail one of the bolt and spacer arrangements of FIG. 9;

FIG. 11 is a view in horizontal section taken substantially on the line 11—11 of FIG. 2;

FIG. 12 is a fragmentary perspective view partly in section showing a lapped joint between two courses of the structure and also showing one of the beams embedded in the spherically shaped wall; and FIG. 13 is a view in vertical section of an alternative embodiment of my invention.

DESCRIPTION OF THE PREFERRED EMBODIMENT

Figure 1:
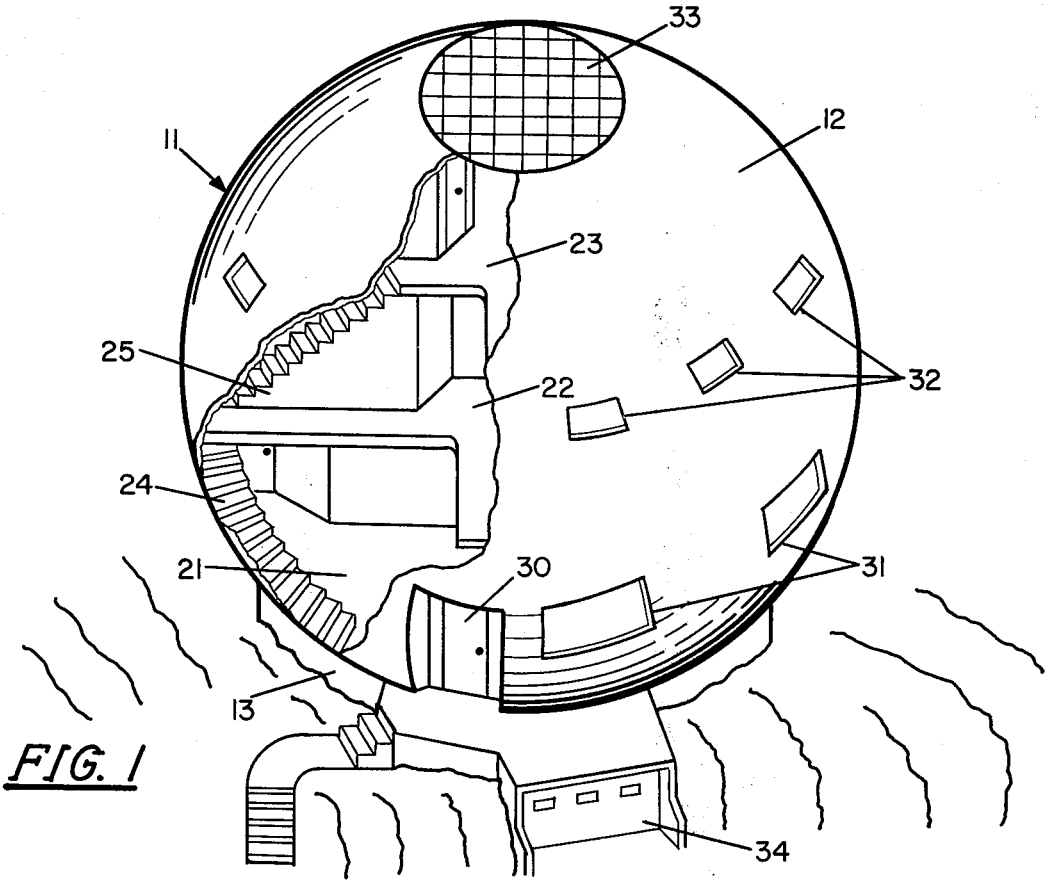
FIG. 1 is a perspective view of a spherically shaped structure used as a dwelling with part of the outer wall broken away to show a portion of the interior of the structure.

Referring to FIG. 1 of the drawings for a more detailed description of the preferred embodiment, a substantially spherical structure is shown at 11. The structure is, for example, intended to serve as a dwelling and is comprised of an upper main spherical wall 12 and a lower cylindrical supporting wall 13. Located within the upper main spherical wall are a first floor 21, a second floor 22, and a third floor 23. Access to the second and third floors may be obtained from the first and second floors respectively via stairs 24 and 25. Entrance to the structure may be gained by a front door 30 leading to first floor 21 or by an entrance 34 leading to the basement bounded by the lower cylindrical supporting wall 13. Natural lighting is provided in the interior of the structure by windows 31 and 32 and by a plastic or glass dome 33. Air circulation within the structure is promoted by openings in portions of the second floor 22 and third floor 23. Although a relatively large portion (approximately one-fourth) of each of the second and third floors is left open in the embodiment illustrated, the exact amount of open space and the number of floors with open spaces is somewhat a matter of choice. The resulting free circulation of air within the structure eliminates the need for extensive ventilation ducting.

Referring now to FIG. 2, there is shown a vertical sectional view of the structure 11. The structure 11 rests upon a footer 45 which is cylindrical in shape. Built upon the footer 45 is a cylindrically shaped wall 13. A spherically shaped wall 12 rests upon the upper edge of cylindrically shaped wall 13. Floors 21, 22 and 23 are supported on wooden beams and joists whose ends are embedded in the spherical wall 12 as later described. The wooden beams of floors 21, 22 and 23 are also supported by columns 41, 42 and 43 respectively. Columns 41 and 42 are substantially centrally located while column 43 is slightly offset. The spherical wall 12 is comprised of a plurality of circular rings or courses connected by lapped joints, as indicated for example at 44, and constructed by a method later described.

Figure 3:
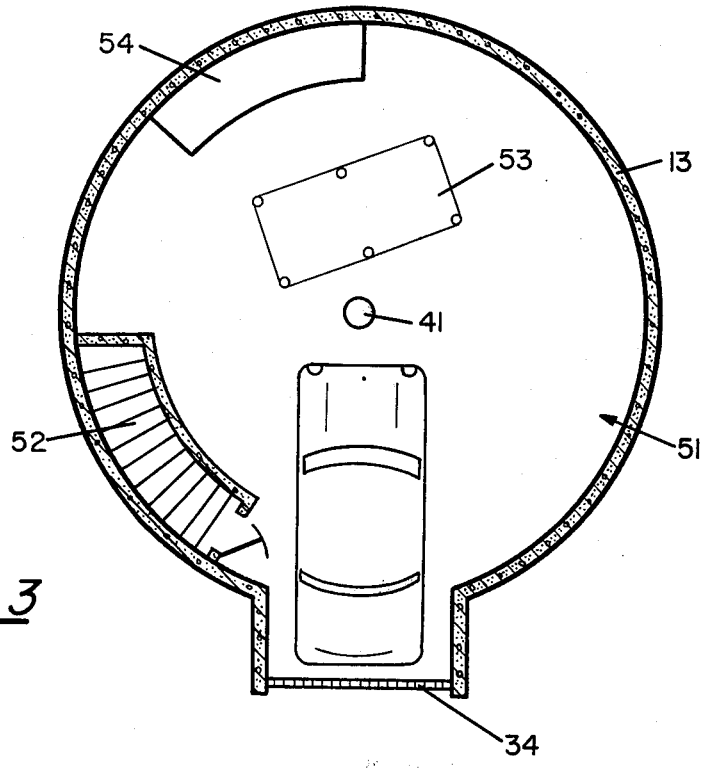
FIg. 3 is a view in horizontal section taken substantially on the line 3—3 of FIG. 2 and showing some details of the basement level.

The floor plan layout of the lower or basement level 51 of the preferred embodiment is illustrated in FIG. 3, which is a sectional view taken on the line 3—3 of FIG. 2. Located within the cylindrical wall 13 are column 41 and basement stairway 52. Stairway 52 provides access to the first floor 21 from the lower level 51. Access to the basement level may also be through basement level entrance 34. A possible arrangement of an automobile, a pool table 53, and a work bench 54, if desired, is also illustrated.

FIG. 4, being a modified (as explained above) sectional view taken substantially on the line 4—4 of FIG. 2, illustrates a possible floor plan layout of the first floor 21. First floor stairway 24 provides access to the second floor 22 from the first floor 21. Front door 30 and side door 61 allow entrance from the outside or exit from the first floor to the outside. Windows 31 around the periphery of the spherical wall 12 at the first floor level provide natural lighting to the interior of the structure at that level. Arranged within the structure may be, if desired, furniture normally found in a living room area 62, a reading area 63, an entrance area 64, a dining area 65, and a kitchen area 66. Closet space 71 may also be provided.

Shown in FIG. 5, which is a sectional view taken substantially on the line 5—5 of FIG. 2, is the floor plan of the second floor 22. Second floor 22 is partitioned into four main sectors, each having a folding door entrance 81. Within each sector may be two closets with folding doors, one closet being located in each outer corner such as indicated at 82. Within one sector 85 are located the bathroom appliances. Access from the first floor to the second floor is by first floor stairway 24 and access to the second floor from the third floor is by second floor stairway 25. Hallway 83 is in reality a balcony and provides access to the stairs 24 and 25 and to study area 84. Natural lighting is provided by windows such as 32 located around the periphery of the structure at the second floor level. Bedroom space may be provided as at 85, 86 and 87.

FIG. 6 shows the floor plan of the third floor. Located around a large part of the periphery is storage area 91. Closets with folding doors may be located as at 92. Furniture may be arranged within the structure to create a den area 93 and a bed-room area 94. Partitions are used to form bathroom area 95. Second floor stairway 25 provides access to the third floor. Air conditioners 96 circulate air to the whole house due to the free air circulation afforded by the large open areas of the second and third floors.

It should be observed that the bathroom and kitchen areas are all located within one quarter section of the structure, thus allowing economical plumbing. The free circulation of air within the structure eliminates the need for extensive ventilation ducting. Heat may be supplied to the structure by individual room electrical baseboard heaters. The structure may also be insulated by spraying the inner walls with a plastic foam.

The preferred embodiment of the invention is constructed of concrete or a similar material. As indicated in FIG. 2, the spherical wall 12 may be constructed on cylindrical wall 13 which rests on cylindrical footer 45. The cylindrical wall 13 and cylindrical footer 45 may be constructed in the conventional manner. However forms similar to forms later described in connection with the construction of the spherical wall 12 may also be used in the construction of the cylindrical wall 13 if desired. The spherical wall 12, however, is preferably constructed by a method described below.

FIG. 7 illustrates an inner form 100 and an outer form 111. Inner form 100 may, as shown, utilize several substantially parallel struts 102. It should include at least two such struts but, as shown, several may be provided. Fastened to each end of said struts 102 and substantially perpendicular thereto are headers such as 104 and 105. Braces 103 provide additional stability to the framework formed by the struts 102 and headers 104 and 105. Each of the struts and each of the headers has at least one curved edge to which a common facer 106 is attached. Holes 107 in each header 104 and 105 and holes 108 in each end strut are provided to allow a plurality of like forms to be fastened together as later described. Outer forms 111 may be fastened to the inner forms 100 as later described and as illustrated in FIGS. 9 and 10.

An outer form 111 is shown more clearly in FIG. 8. The outer form 111 is also comprised of a plurality of substantially parallel struts 112. Fastened to each end of said struts and substantially perpendicular thereto are a pair of headers 113 and 114. Each strut and header has at least one curved edge to which a common facer 115 is attached. Additional stability to the framework formed by struts 112 and headers 113 and 114 may be provided by braces 116. Holes 118 in each header and holes 119 in each strut are provided to allow a plurality of like forms to be fastned together as later described.

Spacer 120, as shown in FIGS. 9 and 10 comprises a tubular member 121 and a threaded rod 122 which cooperate to keep headers 105 and 114 in fixed relative position. The threaded rod 122 extends through the tubular member 121 and through holes in the headers 105 and 114 as well as through holes in the facers 106 and 115 as shown. On each end of the rod 122 are a washer 123 and a nut 124.

The inner forms 100 and the outer forms 111 are designed to be used in cooperation with each other to provide two parallel spherically shaped surfaces, between which concrete or other similar material may ba poured. The preferred method for the use of the forms is to fasten a plurality of inner forms together at their strut ends to form a ring-like structure. Referring to FIG. 7, inner form 100 is bolted to inner form 170 on one end and to inner form 180 on the other end with each subsequent inner form also being bolted to another inner form at each of its strut ends. the resulting structure is a ring with a spherically shaped outer surface. Outer forms are similarly fastened such that two concentric rings are formed. The resulting inner and outer rings are fastened to each other by means of spacers 120 to provide two stable spherically shaped surfaces, between which concrete or other similar material may be poured. Because of the extensive interconnection between the various form sections, a very stable structure which requires no additional shoring, is produced.

The first course for the spherical wall is poured between the aforementioned concentric rings whose lower portion may be fastened to the forms used to construct the cylindrical wall 13. After the first course has hardened a second pair of concentric rings is secured in place to the forms used for the previous course, and a second course is poured between the second set of forms so constructed. The lower headers of the second pair of concentric rings may be fastened to the upper headers of the forms used for the previous course. Subsequent concentric rings are constructed and subsequent courses are poured in a similar manner until the structure is completed. Because of the symmetrical nature of the spherically shaped forms, the same forms used in the construction of the lower portion of the spherically shaped wall may also be reversed and used in the construction of the upper portion of the spherically shaped wall.

The wooden beams and joists on which the floors 21, 22 and 23 are supported were referred to above as embedded in the spherical wall 12 but the method by which these beams and joists were embedded in the wall was not there described. These beams are now referred to as beams 160 and are illustrated in FIGS. 11 and 12. There the beams are designated 160 and the joists are designated 161. The joists are secured to the beams as illustrated for example at 162. The beams 160 and the joists 161 are secured with their uppermost portions in the same horizontal plane so that the floors 21, 22 and 23 may lie flat and horizontal thereon. Each of the beams 160 and the joists 161 have at least one end embedded in the spherical concrete wall 12.

There are several methods by which the beams 160 and the joists 161 may be so embedded. For example, this may be accomplished by making a notch or notches or a hole or holes at the correct position in the appropriate course of the spherical wall 12. This is accomplished by attaching blocks (preferably wooden) to the inner forms prior to pouring the concrete. After the concrete hardens, the blocks are removed and the beams and joists are inserted in the notches thus formed in the concrete.

Also illustrated in FIG. 12 are the details of constructing the lapped joints 44 (See FIG. 2). One method of constructing lapped joints is to attach a wooden spacer bar 150 to the upper edge of the facer of an outer form (as shown in FIG. 12), prior to pouring the concrete so that a notch or groove is formed by the spacer bar 150 when the concrete is poured between the forms. After the concrete has hardened, the bar 150 is removed and the next upper course is poured so that a portion flows into the notch or groove so that it fills the notch or groove, thus forming a lapped joint between the two courses. Tongue and groove joints may be used instead of lapped joints, if desired. One such tongue and groove joint is indicated at 217 of FIG. 13.

Referring back again to the description of FIGS. 7 and 8 on page 10, it will be remembered or may be noted that I have stated that the struts 102 of the inner forms 100 are substantially parallel and that the headers 104 and 105 are substantially perpendicular thereto. Also, I have stated that the struts 112 are substantially parallel and that the headers 113 and 114 are substantially perpendicular thereto. Actually, because the diameters of horizontal sections of any sphere increase as such sections are raised until the great circle of the sphere (equator) is reached and thereafter decrease as such sections are raised, the struts vary slightly from the parallel and at most only one strut of each form is actually perpendicular to headers.

Reference is made above to reinforced concrete walls. The method of constructing the walls and reinforcing the concrete is as follows:

Reinforcement is preferably of the conventional rod type. The preferred embodiment uses ⅜ inch rod with interlocking basket weave of vertical and radial rods on two foot centers. The vertical rods may start in the footer 45 and be interconnected to make continuous rods from the footer up through basement walls 13 and continue into the spherical walls 12 to the top of the sphere. The top of all window and doorway openings should have additional larger diameter rods to support these areas. Doorways and windows should have ¾ inch rods extending four feet on either side of the openings, and the large basement level entrance should have a 1¼ inches rod extending five feet on either side of the opening.

The footer rods are inserted in the poured wet concrete. Two rings may be made from the twenty foot rod sections by lapping 24 inches and connecting with tight wire wraps. These rod rings may be vibrated into the concrete to 8 and 16 inches levels. Vertical rods may then be inserted to within 2 inches from bottom of footer 45 with 24 inches protruding above the footer. The vertical rods may be spaced 24 inches on center. The basement rods may be installed after outer form walls are in place and prior to installing inner form walls. The vertical rods may be wired in place to the protruding rods from the footer. The rods are woven into the vertical rods with a tight wire wrap at each intersection. It might be mentioned at this point that the spacers 120 were installed in the wall as each section of inner form wall was bolted into place.

FIG. 13 is a cross sectional view of an alternative embodiment 201 of the invention. The structure consists of an outer spherical wall 202 which may rest upon or be partially buried in the ground 203. The outer spherical wall 202 is comprised of a series of rings which are connected to each other by lapped joints such as at 206. Tongue in groove joints may also be used as shown at 217. Protruding downward from the bottom of spherical wall 202 is structural member 204 which serves to keep the structure from pitching about its vertical axis. Ballast 205 gives further stability to the structure. Located within the structure 201 are a first level floor 211, a second level floor 212 and a third level floor 213. Supporting the second and third level floors respectively are columns 214 and 215.

The following claims are intended to cover all modifications which do not depart from the spirit and scope of my invention. The invention is not to be necessarily limited to the specific construction illustrated and described, since such construction is only intended to be illustrative of the principles involved and the means presently devised to carry out said principles. It is to be considered that the invention comprehends any minor change in construction that may be permitted within the scope of the appended claims.

I claim:

1. The method of constructing spherically shaped building structures wherein a plurality of annular rings composed of structural material each positioned higher than the next lower annular ring and each having a spherically shaped surface are created by a. the successive forming for each ring below the horizontal equator of the building of a pair of adjacent annular ring forms, one ring form of each pair of ring forms having an arcuate inner surface and the other ring of each pair having an arcuate outer surface forming a portion of a spherical surface and being positioned within the first described ring form of the pair, the said inner and outer surfaces of each said pair being substantially parallel to each other, and each pair of ring forms being substantially parallel to the horizontal equator so that the annular rings to be created will also be parallel to the horizontal equator;

b. pouring suitable structural material between the surfaces of each pair of ring forms and allowing such material to harden before positioning the next higher pair of forms;

c. repeating the process until the horizontal equator is reached;

d. disassembly of the forms for the annular rings below the horizontal equator; and e. inverting the ring forms and utilizing the inverted ring forms in reverse order to complete in similar manner annular rings of the upper portion of spherically shaped building structure.

2. The method of claim 1, wherein the successively formed arcuate rings are lapped at their joints.

* * * * *